US006089403A

United States Patent [19]

Mackal

[11] Patent Number: 6,089,403

[45] Date of Patent: Jul. 18, 2000

[54] INFLATION SYSTEM WITH PNEUMATIC ASSIST

[76] Inventor: Glenn H. Mackal, 2586 25th Ave. North, St. Petersburg, Fla. 33713

[21] Appl. No.: 08/978,339

[22] Filed: Nov. 25, 1997

[51] Int. Cl.[7] ..... B63B 35/58

[52] U.S. Cl. ..... 222/5; 222/83; 222/85; 441/40; 441/93

[58] Field of Search ..... 222/1, 5, 83, 85; 441/70–42, 93–95

[56] References Cited

U.S. PATENT DOCUMENTS

| | | | |
|---|---|---|---|
| 4,805,802 | 2/1989 | MacKendrick et al. | 222/5 |
| 5,395,012 | 3/1995 | Grill et al. | 222/5 |
| 5,664,804 | 9/1997 | Saccone | 222/5 |

*Primary Examiner*—J. Casimer Jacyna
*Attorney, Agent, or Firm*—Smith & Hopen, P.A.; Ronald E. Smith

[57] ABSTRACT

An inflation system with pneumatic assist for a life raft or other inflatable article includes a puncture pin that is mounted to a slideably mounted piston. The puncture pin makes a small initial puncture in the membrane of a gas cartridge to start a trigger flow of compressed gas from the cartridge. That trigger flow travels through a gas passageway formed in the puncture pin and enters a cylinder within which the piston is mounted, driving the piston toward the membrane. A primary membrane cutter is carried by the piston, and the primary membrane cutter bursts through the membrane and unleashes a high volume flow of compressed gas into the article to be inflated. In a second embodiment, the primary membrane cutter is integrally formed with the puncture pin.

3 Claims, 3 Drawing Sheets

INFLATION SYSTEM WITH PNEUMATIC ASSIST

BACKGROUND OF THE INVENTION

1. Field of the Invention

This invention relates, generally, to devices and methods for puncturing a gas cartridge membrane. More particularly, it relates to an inflation system that harnesses the force of gases escaping from a small initial puncture in the membrane to make a much larger subsequent puncture.

2. Description of the Prior Art

Gas cartridges contain gases such as $CO_2$ under pressure and are used to rapidly inflate inflatable articles, i.e., when a gas cartridge membrane is pierced by a movably mounted puncture pin, the compressed gas flows at a high flow volume into a life jacket, a raft, or other inflatable article.

Since the gas is under considerable pressure, the membrane must be made of a strong material. Thus, the force required to puncture it is also considerable. In most devices for puncturing such membranes, a powerful spring is employed to provide the bias needed to drive a puncture pin into the membrane. The devices, known as inflators, provide a housing for the puncture pin, a spring or other bias means for driving the puncture pin, an activation device that releases the energy of the bias means when activated, and a channel for directing escaping gases into an inflatable article. There are many forms of activation devices, including, but not limited to, a cam, a push button, an electric solenoid, or a moisture-sensitive pad that collapses when wet.

There are a number of problems associated with the use of springs as the motive force for a puncture pin. For example, over time a loaded spring gradually loses some resiliency, i.e., the metallic molecules under stress gradually realign themselves to reduce the stress with the result that a long-cocked spring will unload with considerably less force than it would have at an earlier date. If the force has fallen below the threshold required to puncture a gas cartridge membrane, the device fails to perform its intended function. Moreover, a spring unloading its bias exerts its greatest force at a certain point in its stroke; it has much less power towards the end of its stroke. As a result, a puncture that was started with sufficient force may end under insufficient force, thereby curtailing the effectiveness of the inflator.

Moreover, many inflators contain pad-like elements that collapse when wet, as mentioned above; these moisture-responsive elements are used to hold an inflator spring in its loaded configuration so that the spring automatically unloads when moisture is admitted into the inflator, thereby indicating that the life jacket or raft or other inflatable article should be inflated. Unfortunately, the pressing of a spring against such an element stresses the element and shortens its effective lifetime. The unrelenting pressure of the spring weakens the element, making it subject to failure and reducing its reliability, e.g., making it susceptible to collapse under conditions, such as high humidity, where it should not collapse.

Springs fail for many reasons as well, i.e., they become corroded, especially in air where the moisture is from salt water, they get stuck if misaligned by a bump, and so on.

It would therefore be beneficial if an inflator could be developed that did not rely entirely on a spring for all of its functions. Such an inflator would puncture gas cartridge membranes with more reliability than spring-reliant mechanisms. Such an inflator would also lengthen the effective lifetime of any moisture-responsive element therein because such element would no longer be subjected to constant high pressure. Moreover, the elimination of large springs would substantially reduce the cost of manufacturing inflators.

However, in view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious invention. The present invention, in sharp and distinct contrast to the teachings and suggestions of the prior art, is an inflation system with pneumatic assist that employs a small puncture pin having a longitudinally extending gas passageway or channeling means formed therein to make a small, initial puncture in a gas cartridge membrane. Very little force is required to make such initial puncture; no spring is needed in a vest inflator. If a spring is employed, it may be of less strength than the springs used in spring-reliant inflators. The small puncture allows gas to travel through the chaneling means to an enclosed space within the body of the novel inflator. A piston is slideably mounted in the enclosed space, and the gases entering the enclosed space through the puncture pin gas passageway push against the head of the piston, causing it to be displaced toward the membrane. A larger membrane cutting means is carried on the trailing end of the piston and is driven into cutting relation to the membrane by the sliding movement of the piston. When the membrane has been cut by the larger cutting means, gas escapes from the cartridge at a very high flow rate and is channeled or directed into an inflatable article. In this way, the power of the escaping gases freed by the initial, low power puncture is harnessed to make a subsequent, high power puncture of the membrane without a need for a spring or other bias means.

More particularly, the novel inflator includes a main manifold body having a piston-receiving bore formed therein. A piston is slideably mounted in the piston-receiving bore; the piston includes a head and a piston body. The piston head and the piston body have a common, longitudinally extending gas passageway formed therein and a puncture pin is mounted to a trailing end of the piston body. The puncture pin has a gas passageway formed therein that is in fluid communication with the common gas passageway formed in the piston head and the piston body, and a mechanically operated piston displacement means is mounted at a leading end of the inflator. Collectively, the aforementioned gas passageways form a channeling means for directing expanding gases from a small initial puncture to an enclosed space at the leading end of the piston head. A low power piston displacement means is adapted to displace the piston and hence the puncture pin a predetermined distance in a leading-to-trailing direction, the predetermined distance being sufficient to cause the puncture pin to make a small initial or pilot puncture of a membrane of a gas cartridge when a gas cartridge is secured to the inflator. A primary membrane cutter is secured to a trailing end of the piston body, in leading relation to the puncture pin so that the primary membrane cutter is positioned on a leading side of the membrane when the puncture pin punctures the membrane. The piston-receiving bore has a predetermined length such that expanding gases, entering the bore through the gas passageway formed in the puncture pin and the common gas passageway formed in the piston head and the piston body, cause the piston and hence the primary membrane cutter to travel in a leading-to-trailing direction a distance sufficient to drive the primary membrane cutter through the membrane. In this way, a low amount of force is applied to make the initial puncture of the membrane, and the low amount of force is boosted to a larger amount of hydraulic force by a flow of gases into the enclosed space on the leading side of the piston head.

The amount of boost provided may be adjusted by varying the ratio of surface area against which the force is applied on said leading side of said piston head relative to the surface area of the chamber occupied by the leading end of the puncture pin. The pressure in said chamber represents a back pressure that reduces or counteracts the pressure generated on the leading side of the piston head. Accordingly, by sizing the respective surface areas, the back pressure may be harnessed to serve as a brake means in certain applications where braking of the puncture pin may be desireable. The respective surface areas may even be adjusted to provide an abrupt return stroke of the puncture pin in applications where such a return stroke is deemed desireable. A very careful sizing of said respective surface areas could even create an oscillation of the puncture pin.

It is a primary object of this invention to provide an inflator that punctures the membrane of a compressed gas cartridge quickly and effectively without relying solely on springs or their mechanical equivalent.

A closely related object is to provide an inflator where low power springs or other low power mechanical, electrical, pneumatic, or hydraulic means are employed merely to provide a small, initial puncture in a gas cartridge membrane.

Another very important object is to provide an inflator that harnesses the power of gases escaping a cartridge through a small, initial puncture to complete the puncture with an abrupt, powerful stroke that does not further rely on a spring or other pin-driving means.

Still another object is to provide an inflator that is less expensive yet which is more reliable than spring-reliant inflators.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
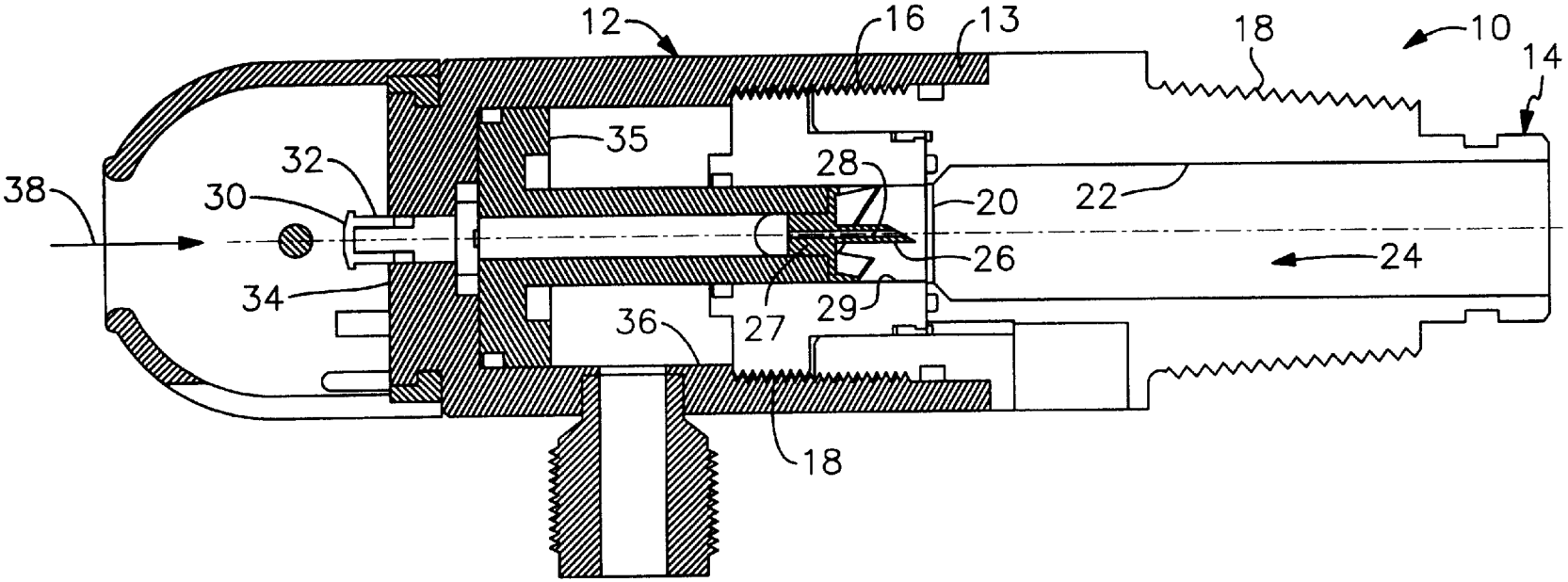
FIG. 1 is a longitudinal sectional view of an exemplary embodiment of the novel inflator when in its stored, unused configuration.

Referring now to FIG. 1, it will there be seen that an exemplary embodiment of the novel inflation system with pneumatic assist is denoted as a whole by the reference numeral 10.

Device 10 is a raft inflator, although it should be understood from the outset that the novel mechanisms disclosed herein have utility in connection with inflators in general, not just raft inflators. Raft inflator 10 includes a manifold main body 12 having an open trailing end 13 that screw threadedly receives the leading end of a gas cartridge 14. More specifically, internal threads 16 formed in trailing end 13 of inflator body 12 engage external threads 18 formed in said leading end of said gas cartridge 14. Membrane 20 closes the leading end of bore 22 formed in cartridge 14, and gases flow through said bore 22 in the direction of arrow 24 when the membrane has been punctured. Forming a large puncture in membrane 20 is required if a life raft, life jacket, or the like is to be inflated rapidly. As mentioned above, springs or equivalent bias means have heretofore been employed as the sole force for driving large puncture pins through such membrane.

In the present inventive structure, novel puncture pin 26, having longitudinal gas passageway 28 formed therein, is advanced in a leading-to-trailing direction by manually applying a low pressure to button 30 at the leading end of inflator body 12. More specifically, button 30 may be mechanically displaced by a cam surface formed in a conventional, pivotally mounted inflator manifold lever, not shown, i.e., such lever is pivoted in a conventional way and its cam surface bears against and displaces button 30. Alternatively, the required initial displacement may be achieved by activation of an electrical solenoid, or in numerous other ways, including springs, known to those in the art.

Button 30 is slideably mounted in bore 32 which is formed in inflator main body 12. Said button 30 has a base 34 that abuttingly engages the leading side of a piston head 35 that is slideably mounted in cylinder 36 which is also formed in said inflator body 12. Accordingly, when button 30 is displaced in the direction indicated by directional arrow 38, piston head 35 is displaced into its FIG. 2 position; this enlarges enclosed space 44, hereinafter sometimes referred to as the leading space.

Figure 2:
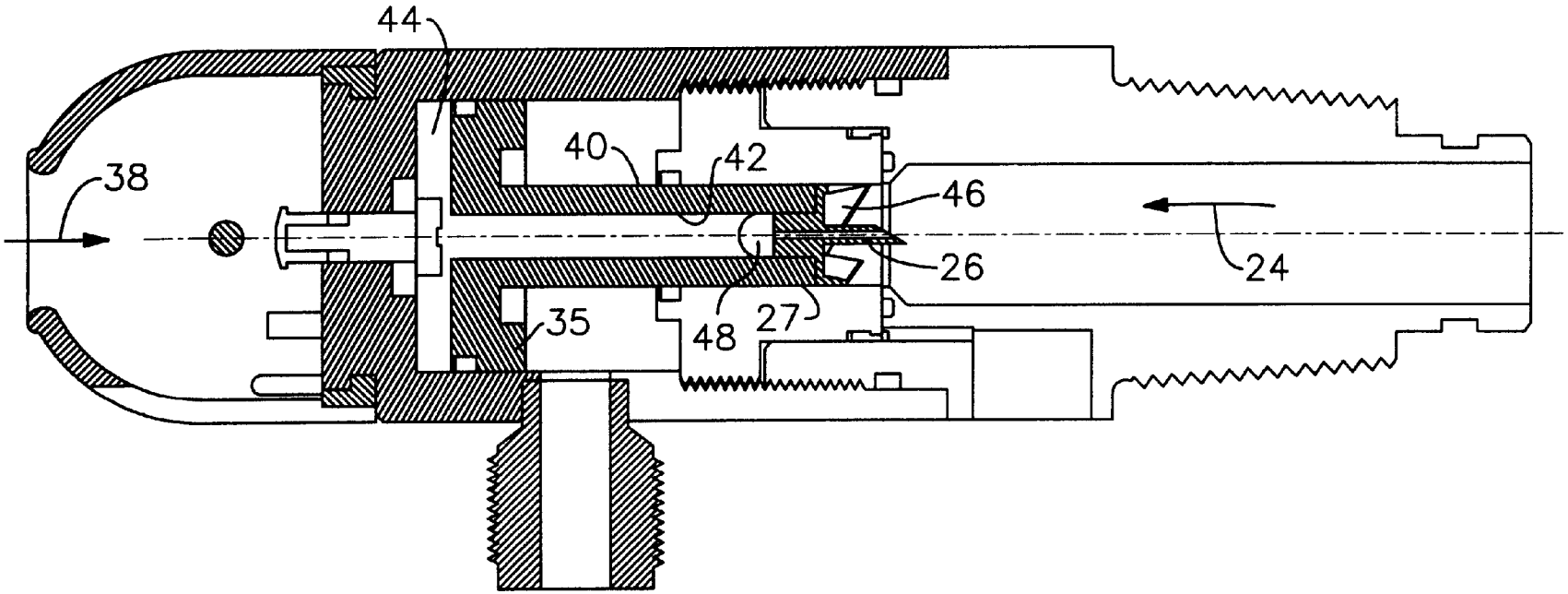
FIG. 2 is a longitudinal sectional view depicting the same parts as FIG. 1 but with the novel puncture pin displaced slightly to make an initial puncture in a gas cartridge membrane.

Piston head 35 and piston body 40, which is formed integrally with said piston head, have a common longitudinal gas passageway 42 formed therein. Puncture pin 26 has a head 27 press fit into said gas passageway 42; thus, gas passageway 28 formed in puncture pin 26 is in fluid communication with common gas passageway 42. Thus, sliding displacement of piston head 35 drives piston body 40 and hence puncture pin 26 in a leading-to-trailing direction as indicated by arrow 38 until said pin punctures membrane 20 as depicted in FIG. 2. This is the initial or pilot or trigger puncturing of said membrane.

Upon completion of said initial puncturing, compressed gas begins to flow in a relatively low volume in the direction of arrow 24; it flows through gas passageway 26 in pin 24 and through common gas passageway 42 formed in piston head 35 and piston body 40 until it enters enclosed space 44 on the leading side of piston head 35. Said compressed gas expands in said space and pushes against piston head 35, driving it and hence piston body 40 in the direction of arrow 38.

Figure 3:
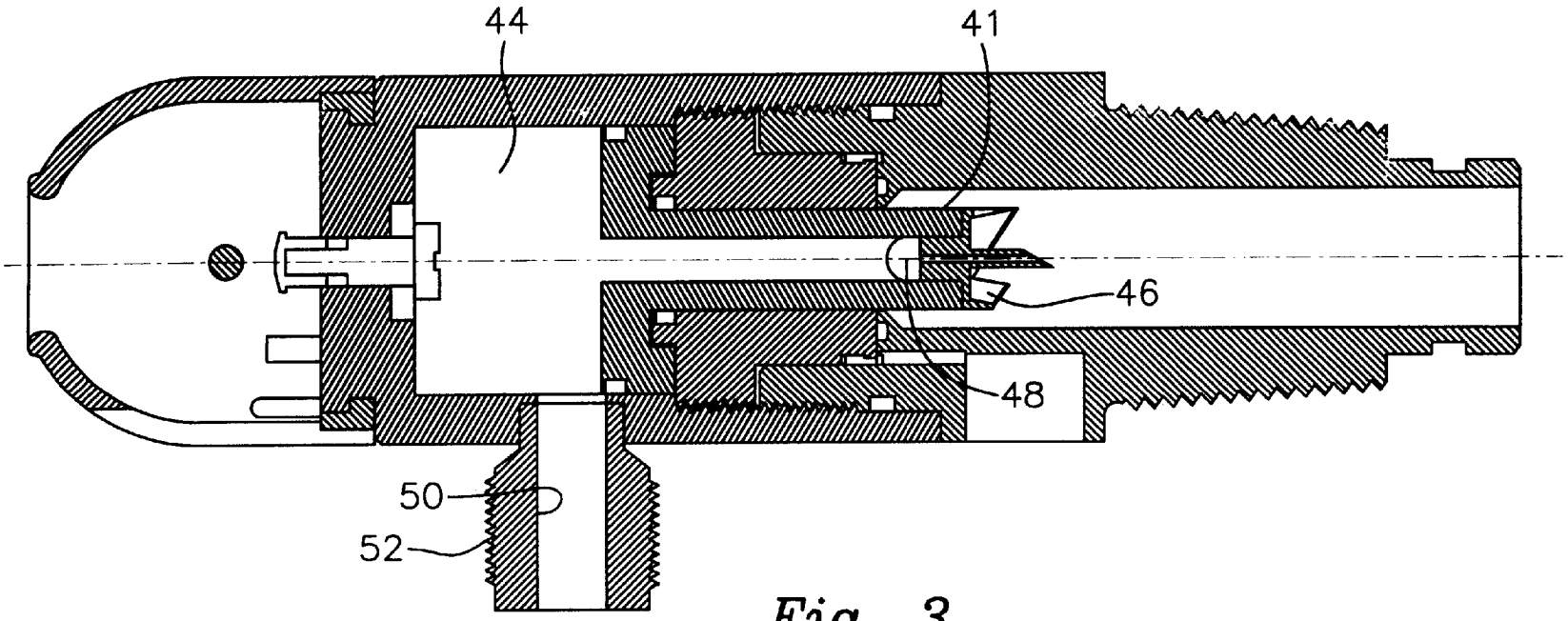
FIG. 3 is a longitudinal sectional view depicting the same parts as FIG. 1 but showing said parts after the membrane has been fully punctured.

A membrane cutting means 46 is carried on the trailing end of piston body 40. As best understood by comparing FIGS. 2 and 3, said membrane cutting means 46 cuts a wide opening in membrane 20 as enclosed leading space 44 expands under the influence of expanding gases. This enables gas to escape from the gas cartridge at a very high volumetric flow rate, flowing around the trailing end 41 of piston body 40 and into gas passageway 42 through a transverse bore 48 formed in said piston body 40. Transverse bore 48 is formed in said piston body 40 adjacent head 27 of puncture pin 26 so that said bore 48 is not in fluid communication with gases flowing from the gas cartridge until enclosed leading space 44 is almost fully expanded. It should be understood that the time required for the novel assembly to move from its FIG. 2 position to its FIG. 3 position is very brief; cutting means 46 practically explodes through membrane 20. The pressure acting against piston head 35 is quite high due to the large surface area of said head and the speed of the expansion of enclosed leading space 44 is rapid in view of the driving force of the expanding gases escaping from the cartridge.

In this way, a relatively low volume, trigger current of compressed gas, initiated by a small, low power initial puncture of membrane 20, which may employ a spring or other means for the sole purpose of making such initial low power puncture, is boosted into a high volume, powerful current that drives cutting means 46 through membrane 20 with explosive force, thereby fully opening a gas cartridge without further reliance upon a spring or similar bias means. The explosive force of the expanding gases drives the cutting means 46 through membrane 20 with a continuous thrust that is not attenuated in strength during the stroke as would be the case if a spring were used.

This is the world's first inflator that harnesses the force of expanding gases from a gas cartridge to fully open the cartridge. The time delay between the initial, low pressure puncture and the subsequent, high pressure puncture is insignificant in view of the explosive force of the gases flowing from the cartridge.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An inflation system with pneumatic assist, comprising:

a housing to which a gas cartridge is releasably connectable;

a puncture pin slideably mounted in said housing for puncturing a membrane of said gas cartridge;

said puncture pin having a uniform diameter and a sharp pointed end for making a small initial puncture in said membrane under a small application of pressure;

an membrane cutting means disposed in trailing relation to said sharp pointed end of said puncture pin, said membrane cutting means having a breadth substantially greater than a breadth of said puncture pin and being adapted to enlarge said small initial puncture;

a piston slideably mounted in said housing, said piston having a head at its leading end and said puncture pin being secured to said piston at a trailing end of said piston;

low power means for displacing said piston and hence said puncture pin a short distance to form said small initial puncture in said membrane;

channeling means for directing gases flowing through said small initial puncture into an enclosed space at the head of said piston;

said channeling means being a longitudinally extending bore formed in said puncture pin;

whereby gases flowing into said enclosed space cause said enclosed space to expand, thereby displacing said piston and driving said enlarged membrane cutting means through said membrane, thereby enlarging said small initial puncture;

whereby said low power means makes said small initial puncture; and whereby a large amount of force required to enlarge said small initial puncture by driving said enlarged membrane cutting means through said membrane is supplied by gases escaping through said small, initial puncture.

2. An inflation system with pneumatic assist, comprising:

a main manifold body having a piston-receiving bore formed therein;

a piston slideably mounted in said piston-receiving bore;

said piston including a piston head and a piston body, said piston head and said piston body having a common gas passageway formed therein;

a puncture pin means mounted to a trailing end of said piston body, said puncture pin means having a uniform diameter and a gas passageway means formed therein, in the form of a longitudinally extending bore formed in said puncture pin, that is in fluid communication with the common gas passageway formed in said piston head and said piston body;

piston initial displacement means mounted at a leading end of said inflator, said piston initial displacement means adapted to displace said piston and hence said puncture pin means a predetermined distance in a leading-to-trailing direction, said predetermined distance being sufficient to cause said puncture pin means to make an initial puncture in a membrane of a gas cartridge when a gas cartridge is secured to said inflator;

an enclosed leading space bounded by said piston-receiving bore and a leading side of said piston head, said enclosed leading space being enlarged by said displacement of said piston by said initial displacement means;

said enclosed leading spaced being in fluid communication with said common gas passageway formed in said piston head and said piston body so that compressed gas escaping from said gas cartridge flows through said puncture pin gas passageway means and said common gas passageway and into said enclosed leading space after said initial puncture has been made;

a primary membrane cutting means secured to a trailing end of said piston body, in leading relation to said puncture pin means so that said primary cutting means is positioned on a leading side of said membrane when said puncture pin means makes said initial puncture in said membrane;

said primary cutting means provided in the form of at least one cutting blade mounted to a trailing end of said piston body, and said at least one cutting blade having a breadth substantially greater than a breadth of said puncture pin;

said piston-receiving bore having a predetermined length such that said compressed gas flowing into said enclosed leading space causes said piston and hence said primary cutting means to travel in a leading-to-trailing direction a distance sufficient to drive said primary cutting means through said membrane;

whereby a low amount of mechanical force is applied to make the initial puncture of said membrane; and whereby said low amount of mechanical force is boosted to a larger amount of hydraulic force by said flow of compressed gas into said enclosed leading space.

3. A method for introducing compressed gas into an inflatable article, comprising the steps of:

using a small amount of mechanical force to make a small initial puncture, with a puncture pin means having a uniform diameter, in a membrane of a gas cartridge, said small initial puncture being sufficient to start a low volume flow of compressed gas from said gas cartridge and being insufficient to start a high volume flow;

channeling into a cylinder through a longitudinally extending bore formed in said puncture pin an initial, low volume flow of compressed gas escaping through said initial puncture;

slideably mounting a piston in said cylinder so that said piston is displaced toward said membrane as said compressed gas flows into said cylinder on a leading side of said piston; and positioning a puncture-enlarging means, including at least one cutting blade having a breadth substantially greater than a breadth of said puncture pin, in leading relation to said piston and in trailing relation to said puncture pin for enlarging said small initial puncture so that as said piston is displaced by expanding compressed gas, said puncture-enlarging means engages and cuts said membrane to an extent sufficient to cause an abrupt emptying of said gas cartridge.

* * * * *